US009307589B2

(12) United States Patent
Chen et al.

(10) Patent No.: US 9,307,589 B2
(45) Date of Patent: Apr. 5, 2016

(54) ILLUMINANT DEVICE AND LIGHTING MODULE THEREOF

(71) Applicant: Lediamond Opto Corporation, New Taipei (TW)

(72) Inventors: Peng-Yu Chen, New Taipei (TW); Chung-Ting Tseng, New Taipei (TW); Hsuan-Hsien Lee, New Taipei (TW)

(73) Assignee: Lediamond Opto Corporation, New Taipei (TW)

( * ) Notice: Subject to any disclaimer, the term of this patent is extended or adjusted under 35 U.S.C. 154(b) by 28 days.

(21) Appl. No.: 14/137,711

(22) Filed: Dec. 20, 2013

(65) Prior Publication Data

US 2015/0181657 A1 Jun. 25, 2015

(51) Int. Cl.

| | |
|---|---|
| ***H05B 33/08*** | (2006.01) |
| ***F21K 99/00*** | (2010.01) |
| ***F21V 23/00*** | (2015.01) |
| *F21Y 101/02* | (2006.01) |
| *F21Y 111/00* | (2006.01) |

(52) U.S. Cl.

CPC ..... *H05B 33/0803* (2013.01); *F21K 9/00* (2013.01); *F21V 23/006* (2013.01); *F21Y 2101/02* (2013.01); *F21Y 2111/001* (2013.01)

(58) Field of Classification Search

CPC ..... F21Y 2101/02; F21Y 2105/001; F21Y 2103/003; F21Y 2111/001; F21K 9/30; F21K 9/50; F21K 9/00

USPC ..... 362/249.01–249.19

See application file for complete search history.

(56) References Cited

U.S. PATENT DOCUMENTS

| | | | | |
|---|---|---|---|---|
| 2012/0268936 | A1* | 10/2012 | Pickard | F21K 9/135 362/249.02 |
| 2013/0027928 | A1* | 1/2013 | Kang et al. | 362/235 |
| 2014/0369037 | A1* | 12/2014 | Hsu | F21V 29/74 362/235 |

FOREIGN PATENT DOCUMENTS

| | | | |
|---|---|---|---|
| CN | 102109115 | B | 8/2012 |
| CN | 202469651 | U | 10/2012 |
| CN | 202521271 | U | 11/2012 |

* cited by examiner

*Primary Examiner* — Alexander H Taningco
*Assistant Examiner* — Seokjin Kim
(74) *Attorney, Agent, or Firm* — Muncy, Geissler, Olds & Lowe, P.C.

(57) ABSTRACT

A lighting module includes a main circuit board, a plurality of lighting units, and a driving unit. The main circuit board forms a plurality of through holes. Each lighting unit includes a transparent substrate, a circuit layer, a plurality of light emitting diode (LED) dies, and a transparent resin layer. The transparent substrates are arranged on the main circuit board, and then a predetermined angle spans between a first surface of each transparent substrate and the main circuit board. The circuit layer and the LED dies are placed on the first surface, and the LED dies are electrically connected to the circuit layer. The transparent resin layer covers the LED dies. The driving unit includes a driving circuit board including a plurality of protrusions. The protrusions are respectively inserted into the through holes such that the driving circuit board is substantially perpendicular to the main board.

10 Claims, 8 Drawing Sheets

ILLUMINANT DEVICE AND LIGHTING MODULE THEREOF

BACKGROUND OF THE INVENTION

1. Field of the Invention

The present invention relates to an illuminant device and a lighting module, and in particular to an illuminant device and a lighting module using light emitting diodes (LEDs) as light source.

2. Description of Related Art

A light emitting diode (LED) is a kind of semiconductor device, which exploits the property of direct-bandgap semiconductor material to convert electric energy into light energy efficiently and has the advantages of long service time, high stability and low power consumption and is developed to replace the traditional non-directivity light tube and incandescent lamp.

Reference is made to FIG. 1, which is sectional view of a conventional illuminant device. The illuminant device 1 includes a housing 10, a lighting module 12, a driving module 14, a cover 16, and a plurality of connecting lines 18. The housing 10 defines an accommodating space 100. The driving module 14 is located within the accommodating space 100 and is configured to drive the lighting module 12. The lighting module 12 including a circuit board 120 and a plurality of light emitting diodes (LEDs) 122 is arranged on one side of the housing 10 and electrically connected to the driving module 14 via the connecting lines 18. The circuit board 120 is a plate and includes a surface 121. The surface 121 is a plane of the circuit board 120 with larger area. The LEDs 122 are placed on the surface 121 of the circuit board 120 and electrically connected thereto such that light emitted from the LEDs 122 transmits to a direction opposite to the housing 10. The cover 16 is assembled with the housing 10 such that the lighting module 12 is located between the cover 16 and the housing 10.

However, the LEDs 122 are light source having characteristic of directivity such that light emitted from the LEDs 122 just can transmit forwards (namely, the light emitted from the LEDs 122 transmits to the direction opposite to the housing 10), and the illuminant area and lighting demand of the illuminant device 1 cannot compete with halogens bulb for non-directivity requirement, and then usage desire of user is reduced.

In additions, the lighting module 12 is electrically connected to the driving module 14 via the connecting lines 18, and while assembling the illuminant device 1, soldering process must be proceeded between contacts of the connecting lines 18 and the lighting module 12, and the connecting lines 18 and the driving module 14, which causes manufacturing process becoming more difficult. Besides, the connecting lines 18 connected to the lighting module 12 and driving module 14 can fall off from the contacts between the connecting lines 18 and the lighting module 12 or the connecting lines 18 and the driving module 14 by impacting, and then the illuminant device 1 cannot illuminate.

SUMMARY OF THE INVENTION

It is an object to provide a lighting module.

Accordingly, the lighting module includes a main circuit board, a plurality of lighting units, and a driving unit. The main circuit board forms a plurality of through holes. The lighting units are arranged on the main circuit board and electrically connected to the main circuit board. Each lighting unit comprises a transparent substrate, a circuit layer, a plurality of light emitting diode (LED) dies, and a transparent resin layer. The transparent substrate comprises a first surface and a second surface opposite to the first surface. The transparent substrate is arranged on the main circuit board, and then a predetermined angle spans between the first surface of the transparent substrate and the main circuit board. The circuit layer is placed on the first surface. The LED dies are placed on the first surface and electrically connected to the circuit layer. The transparent resin layer is disposed on the first surface and the second surface, the transparent resin layer covers the LED dies and partially covers the circuit layer. The driving unit comprises a driving circuit board and a driver, the driving circuit board comprises a plurality of protrusions respectively inserted into the through holes such that the driving circuit board is substantially perpendicular to the main circuit board and electrically connected to the main circuit board. The driver is placed on the driving circuit board and electrically connected to the driving circuit board.

In an embodiment of the present invention, the main circuit board forms a plurality of grooves, the transparent substrates of the lighting units are respectively inserted into the grooves.

In an embodiment of the present invention, the predetermined angle is 90 degrees.

In an embodiment of the present invention, the lighting module further comprises a plurality of connecting members respectively arranged between the main circuit board and the circuit layers of the lighting units, the connecting members are used for physically and electrically connecting the main circuit board and the lighting units.

In an embodiment of the present invention, the predetermined angle is larger than 90 degrees.

In an embodiment of the present invention, the lighting module further comprises a plurality of connecting terminals connected to the driving circuit board.

In an embodiment of the present invention, the lighting units are arranged on the main circuit board in an equiangular manner.

It is another object to provide an illuminant device. Accordingly, the illuminant device comprises a housing and a lighting module. The housing comprises a circumferential wall and a bottom wall connected to the circumferential wall. The circumferential wall and the bottom wall collectively define an accommodating space and an opening communicating with the accommodating space. The bottom wall forms a plurality of penetrating holes. The lighting module comprises a main circuit board, a plurality of lighting units, and a driving unit. The main circuit board seals the opening. The main circuit board forms a plurality of through holes. The lighting units are arranged on the main circuit board and electrically connected to the main circuit board. Each lighting unit comprises a transparent substrate, a circuit layer, a plurality of LED dies, and a transparent resin layer. The transparent substrate comprises a first surface and a second surface opposite to the first surface, the transparent substrate is arranged on the main circuit board, and then a predetermined angle spans between the first surface of the transparent substrate and the main circuit board. The circuit layer is placed on the first surface. The LED dies are placed on the first surface and electrically connected to the circuit layer. The transparent resin layer is disposed on the first surface and the second surface, the transparent resin layer covers the LED dies and partially covers the circuit layer. The driving unit is arranged within the accommodating space, the driving unit comprises a driving circuit board and a driver. The driving circuit board comprises a plurality of protrusions inserted into the through holes, respectively, such that the driving circuit board is perpendicular to the main circuit board and electrically connected to the main circuit board. The driver is placed on the driving circuit board and electrically connected to the driving circuit board.

In an embodiment of the present invention, the main circuit board forms a plurality of grooves, the transparent substrates of the lighting units are respectively inserted into the grooves.

In an embodiment of the present invention, the predetermined angle is 90 degrees.

In an embodiment of the present invention, the illuminant device further comprises a plurality of connecting members respectively arranged between the main circuit board and the circuit layers of the lighting units, the connecting members are used for connecting the main circuit board and the circuit layers.

In an embodiment of the present invention, the predetermined angle is larger than 90 degrees.

In an embodiment of the present invention, the lighting units are arranged on the main circuit board in an equiangular manner.

In an embodiment of the present invention, the illuminant device further comprises a cover assembled with the housing such that the lighting unit is arranged between the main circuit board and the cover.

In an embodiment of the present invention, the illuminant device further comprises a plurality of connecting terminals connecting to the driving circuit board and penetrating the penetrating holes.

In an embodiment of the present invention, the cover comprises a supporting portion and a plurality of fastening portions connected to the supporting portion, the supporting portion is assembled with the housing such that a predetermined distance is between the fastening portions and the main circuit board, the fastening portions are correspondingly arranged on the lighting units.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

A preferred embodiment of the present invention will be described with reference to the drawings.

Figure 2:
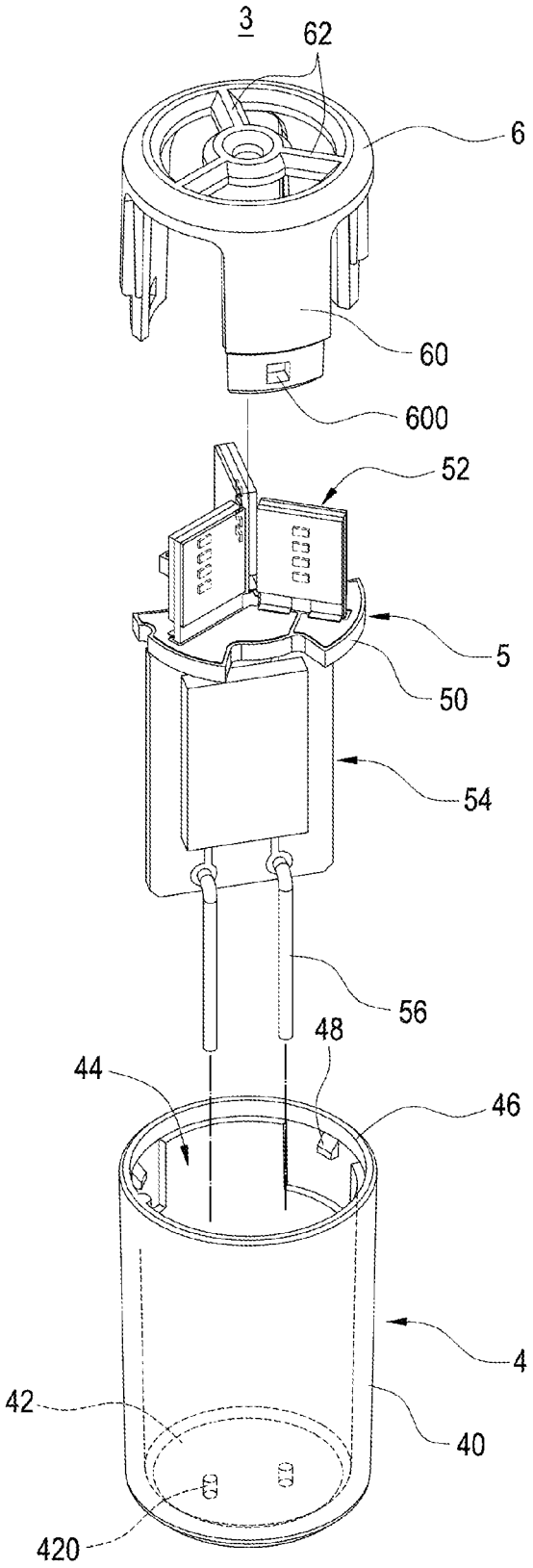
FIG. 2 is an explored view of an illuminant device according to a first embodiment of the present invention.
Figure 3:
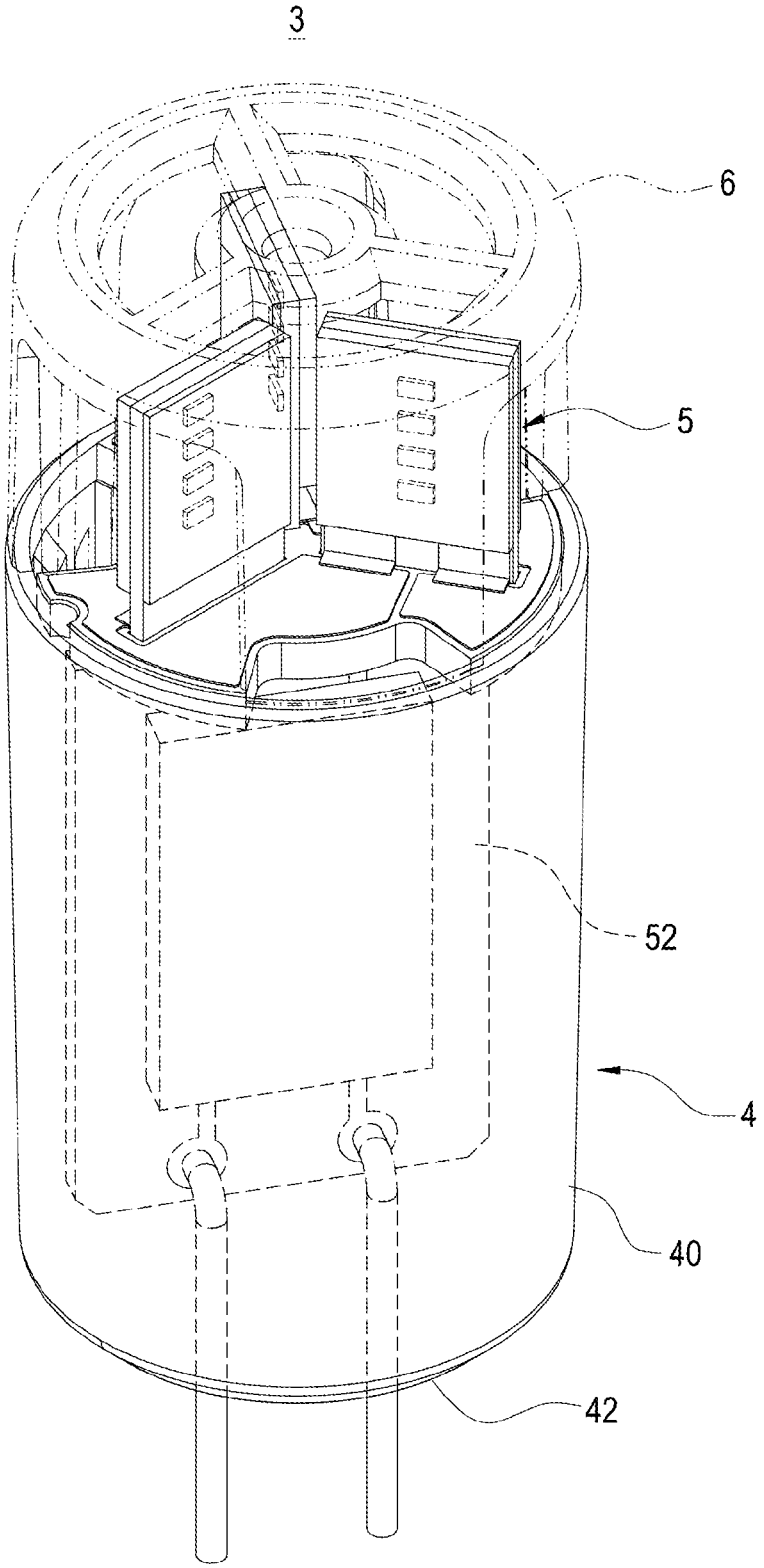
FIG. 3 is an assembled view of the illuminant device according to the first embodiment of the present invention.

Reference is made to FIG. 2 and FIG. 3, which are respectively an exploded view and an assembled view of an illuminant device according to a first embodiment of the present invention. The illuminant device 3 is used for providing a light source with an illuminant angle larger than 180 degrees. The illuminant device 3 includes a housing 4, a lighting module 5, and a cover 6.

The housing 4 includes a circumferential wall 40 and a bottom wall 42 connected to a bottom edge of the circumferential wall 40. The circumferential wall 40 and the bottom wall 42 collectively define an accommodating space 44 and an opening 46 communicating with the accommodating space 44. The housing 4 further includes a plurality of engaging members 48 and a plurality of penetrating holes 420, the engaging members 48 are formed on the circumferential wall 40 and adjacent the opening 46, and the penetrating holes 420 are formed on the bottom wall 42. In this embodiment, an amount of the penetrating holes 420 is, for example, two.

Figure 1:
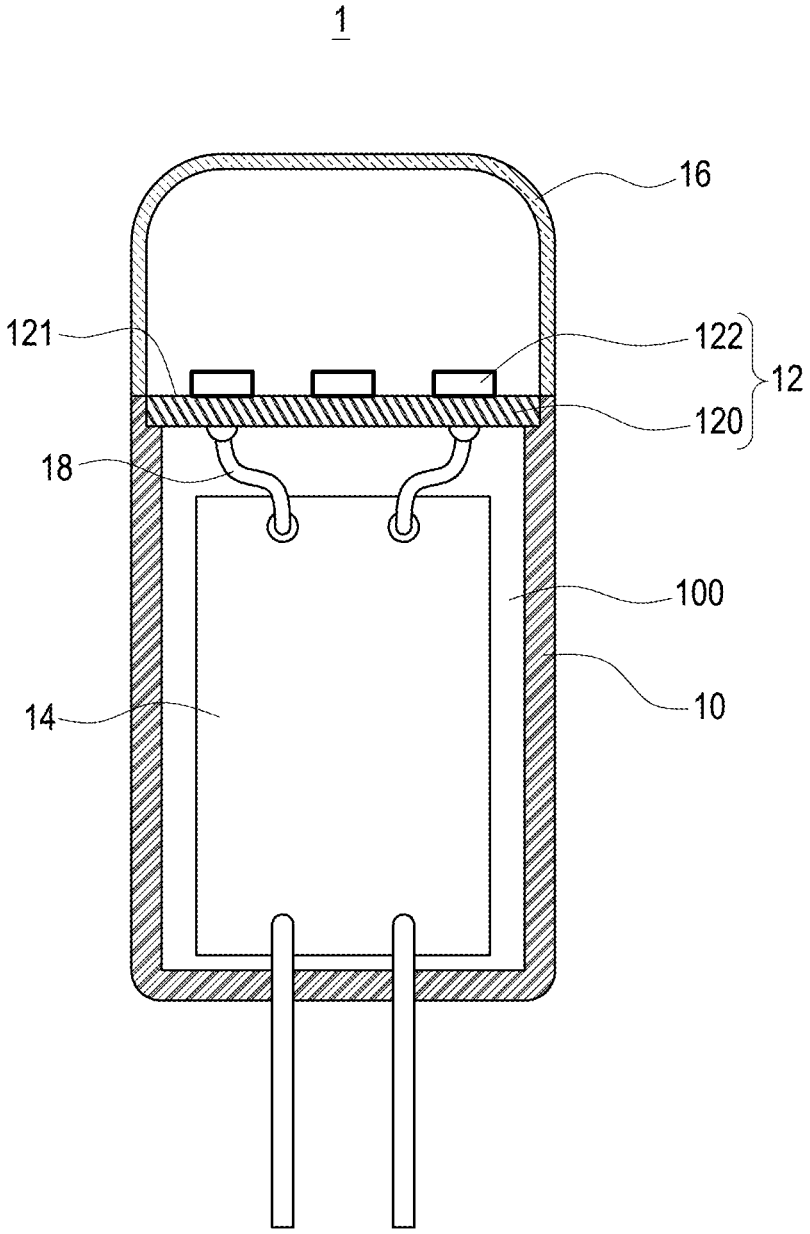
FIG.1 RELATED ART
FIG. 1 is a sectional view of a conventional illuminant device.
Figure 4:
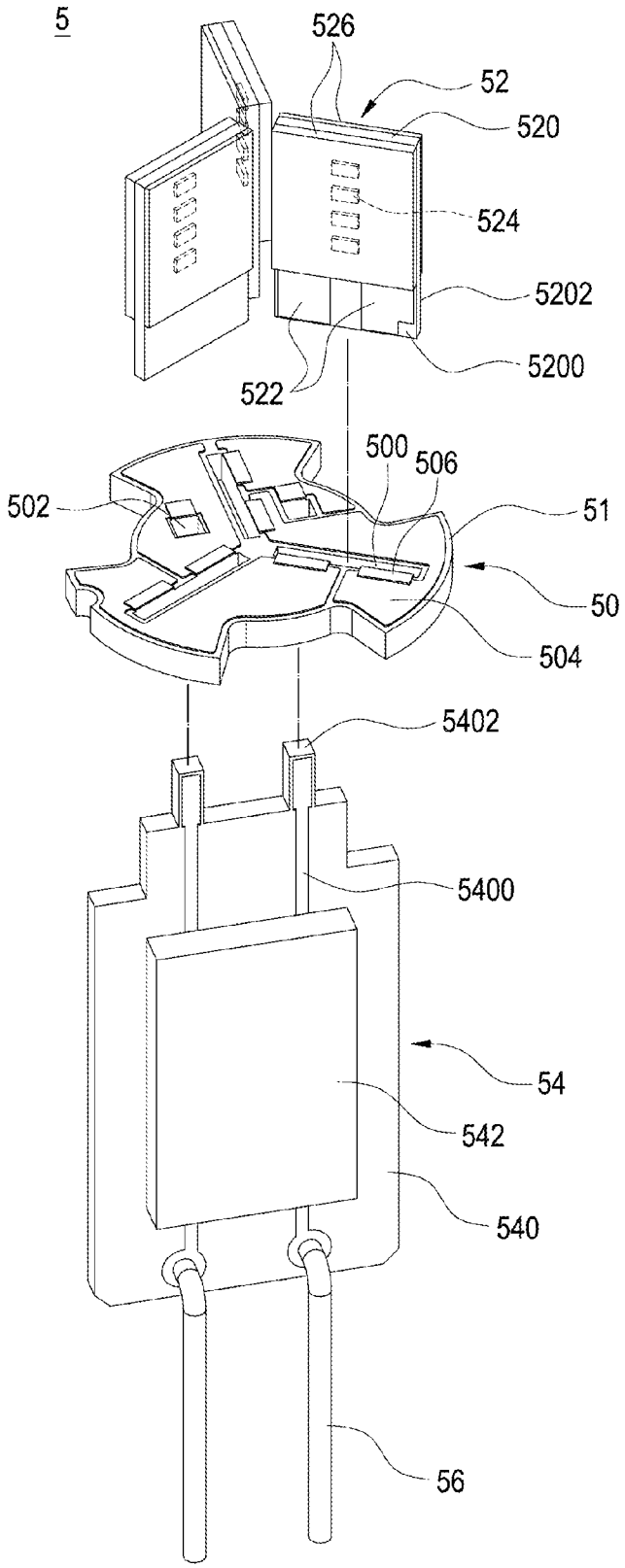
FIG. 4 is an explored view of a lighting module according to the first embodiment of the present invention.
Figure 5:
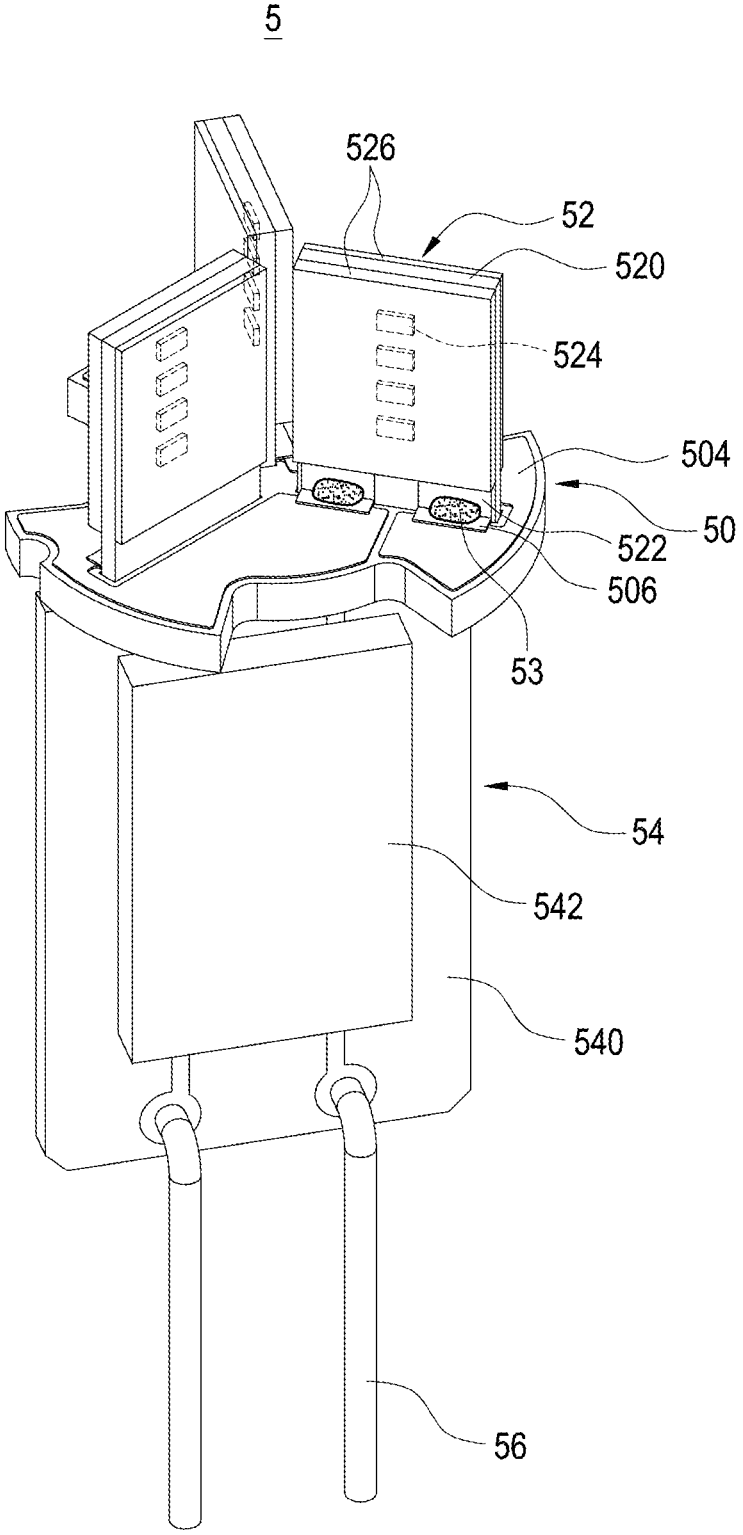
FIG. 5 is an assembled view of the lighting module according to the first embodiment of the present invention.
Figure 6:
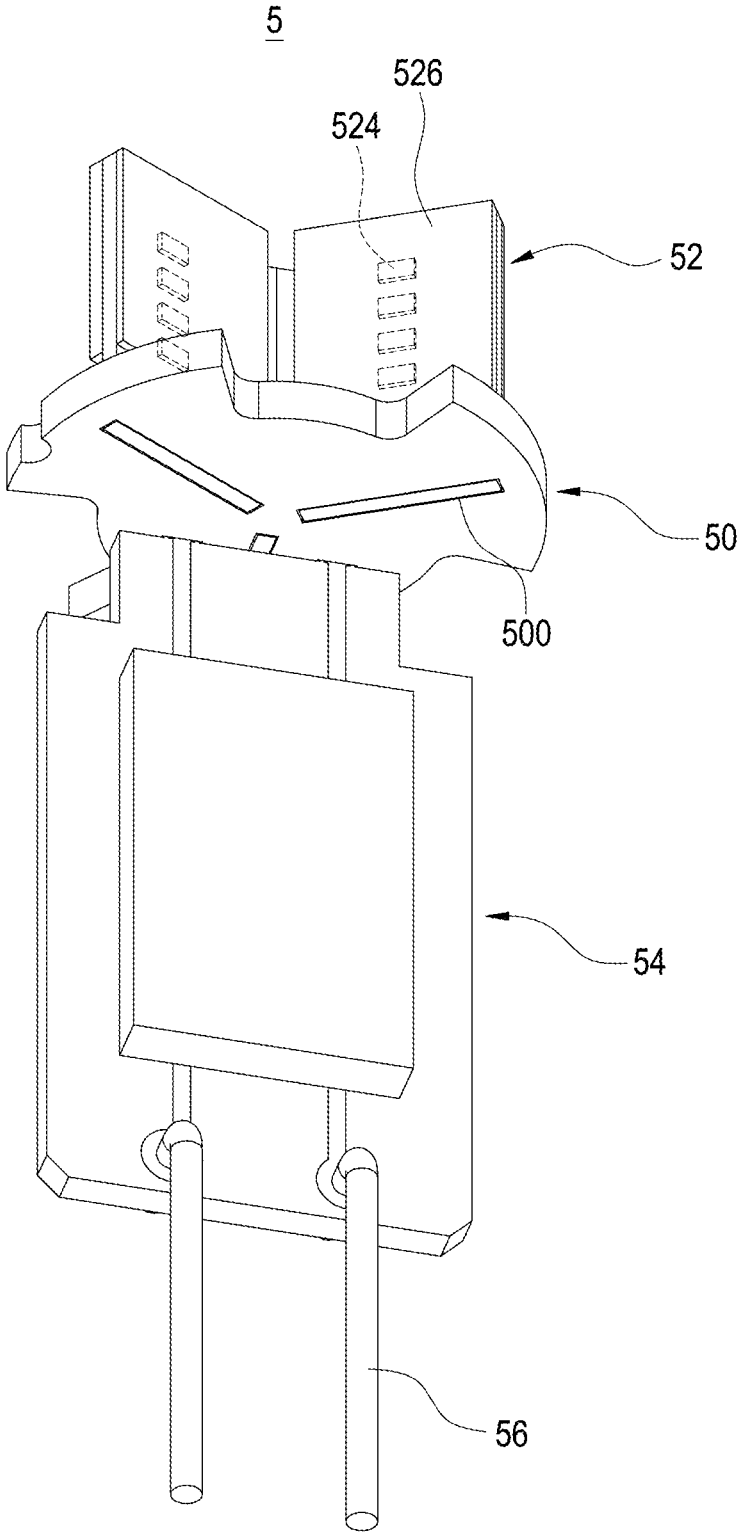
FIG. 6 is another assembled view of the lighting module according to the first embodiment of the present invention.

Reference is made to FIGS. 4, 5, and 6. The lighting module 5 includes a main circuit board 50, a plurality of lighting units 52, a driving unit 54, and a plurality of connecting terminals 56. The main circuit board 50 seals the opening 46 (as shown in FIG. 1 and FIG. 2). The main circuit board 50 forms a plurality of grooves 500 and a plurality of through holes 502. In this embodiment, the grooves 500 and the through holes 502 are structures penetrating through the main circuit board 50. However, the grooves 500 and the through holes 502 can be structures which are not penetrating through the main circuit board 50. The main circuit board 50 is, for example, printed circuit board. A plurality of circuit traces 504 and pads 506 are placed on a surface 51 of the main circuit board 50, the pads 506 are arranged adjacent the grooves 500 and the through holes 502 and electrically connected to the circuit traces 504. It should be noted that while the surface 51 and another surface (not labeled) of the main circuit board 50 opposite to the surface 51 are placed with the circuit traces 504 and pads 506, the grooves 500 and the through holes 502 are structures which are not penetrating the main circuit board 50.

Each lighting unit 52 includes a transparent substrate 520, a circuit layer 522, a plurality of light emitting diode (LED) dies 524, and a transparent resin layer 526. The transparent substrate 520 is, for example, made of glass or quartz, and includes a first surface 5200 and a second surface 5202 opposite to the first surface 5200. In this embodiment, the first surface 5200 and the second surface 5202 are plane with larger area of the transparent substrate 520.

The circuit layer 522 is placed on the first surface 5200 of the transparent substrate 520. The circuit layer 522 is made of material with electrically conductivity and used for being conductive route of electric power.

The LED dies 524 are place on the first surface 5200 and electrically connected to the circuit layer 522. In this embodiment, the LED dies 524 are, for example, arranged in a linear manner.

The transparent resin layer 526 is disposed on the first surface 5200 and the second surface 5202. The transparent resin layer 526 covers the LED dies 524, and partially covers the circuit layer 522 (namely, a portion of circuit layer 522 expose out of the transparent resin layer 526). The transparent resin layer 526 is, for example, made of epoxy or silicone resin. The transparent resin layer 526 is used for providing a light-mixing space to light emitted from the LED dies 524 such that uniformity of light emitted from the lighting unit 52 can be effectively increased. Meanwhile, the transparent resin layer 526 prevents the LED dies 524 from moisture permeating and damaging causes by impact. It should be noted that the transparent resin layer 526 can include a wavelength converting material (not shown), such as phosphor, disposed therein. The wavelength converting material is excited by partial light emitted from the LED dies 524 and then converts the light into a wavelength-converted light, which is to be mixed with the other light emitted from the LED dies 524 to generate a light with demand color.

The lighting units 52 are inserted into the grooves 500 such that a predetermined angle spans between the first surface 5200 of each transparent substrate 520 and the surface 51 of the main circuit board 50, and the circuit layers 522 of the lighting units 52 are in contact with the pads 506 of the main circuit board 50. It should be noted that while the lighting units 52 are inserted into the grooves 500, one end of each circuit layers 522 which is not disposed with the transparent resin layer 526 is accommodating within the grooves 500, and the circuit layers 522 which are not disposed with the transparent resin layer 526 are in contact with the pads 506 of the main circuit board 50. In this embodiment, the predetermined angle spanning between the first surface 5200 of each transparent substrate 520 and the main circuit board 50 is 90 degrees, and the lighting units 52 are arranged on the main circuit board 50 in an equiangular manner. However, the lighting units 52 can be arranged in other manners to increase uniformity of light emitted from the illuminant device 3. In particularly, solder 53 (as shown in FIG. 5) may be disposed between the circuit layer 522 and the pads 506 by soldering processor to increase connecting strength and electrically connecting ability of the circuit layer 522 and the pads 506. Thus, the lighting units 52 are electrically connected to the main circuit board 50.

The driving unit 54 includes a driving circuit board 540 and a driver 542. The driving circuit board 540 is, for example, printed circuit board, and copper foils 5400 are placed thereon. A profile of the driving circuit board 540 is, for example, rectangular, and a plurality of protrusions 5402 are formed on one end thereof. The copper foils 5400 are also placed on the protrusions 5402. The protrusions 5402 are inserted into the through holes 502 such that the driving circuit board 540 is substantially perpendicular to the main circuit board 50, and the copper foils 5400 are in contact with the pads 506 of the main circuit board 50. In particularly, solder 53 can be disposed between the copper foils 5400 and the pads 506 to increase connecting strength and electrically connected ability of the copper foils 5400 and the pads 506. Thus, the driving unit 54 is electrically connected to the main circuit board 50.

The driver 542 is placed on the driving circuit board 540 and electrically connected to the copper foils 5400. The driver 542 is configured to drive the lighting units 52. The driver 542 includes, for example, alternative current (AC) to direct current (DC) converting circuit.

The connecting terminals 56 are connected to the driving circuit board 540 and electrically connected to the copper foils 5400. In this embodiment, the lighting module 5 includes, for example, two connecting terminals 56. In the practical applications, an amount of the connecting terminals 56 is equal to the amount of the penetrating holes 420 formed on the bottom wall 42 of the housing 4.

With refer again to FIG. 2 and FIG. 3, the driving unit 54 is located within the accommodating space 44 when assembling the illuminant device 3. The connecting terminals 56 pass through the penetrating holes 420 formed on the bottom wall 42. The connecting terminals 56 exposing out of the housing 4 are inserted in an external socket (not shown) to acquire electric power for the illuminant device 3 while the illuminant device 3 is lit.

The cover 6 is assembled with the housing 4 such that the lighting units 52 are located between the cover 6 and the main circuit board 50. The cover 6 includes a supporting portion 60 and a plurality of fastening portions 62 connected to the supporting portion 60. The supporting portion 60 is assembled with the housing 4 such that a predetermined distance is between the fastening portions 62 and the main circuit board 50. The supporting portion 60 includes a plurality of engaging holes 600 formed thereon. The engaging holes 600 are assembled with the engaging members 48 formed on the circumferential wall 48, respectively, for fixing the cover 6 on the housing 4. The fastening portions 62 are correspondingly arranged above the lighting units 52 to prevent the lighting units 52 from rotating causes by impact.

To sum up, the lighting units 52 and the driving unit 54 of the lighting module 5 are respectively inserted into the main circuit board 50 and electrically connected thereto, thus the assembling difficulty can be effectively improved (namely, the assembling difficulty of the lighting units 52, the driving unit 54, and the main circuit board 50 is reduced). The connecting strength between the lighting units 52, the driving unit 54, and the main circuit board 50 is also improved (namely, the connecting strength between the lighting unit 52, the driving unit 54, and the main circuit board 50 is increased) and can effectively prevent the lighting units 52 and the driving unit 54 from separating causes by impact due to the lighting units 52 and the driving unit 54 are respectively inserted into the main circuit board 50 and electrically connected thereto. Besides, while the lighting units 52 are inserted into the grooves 500, the lighting units 52 stand on the main circuit board 50, thus the illuminant angle of the illuminant device 3 can be effectively increased and then illuminant angle and radiation pattern of a light source provided by the illuminant device 3 is similar to that of halogens bulb.

Figure 7:
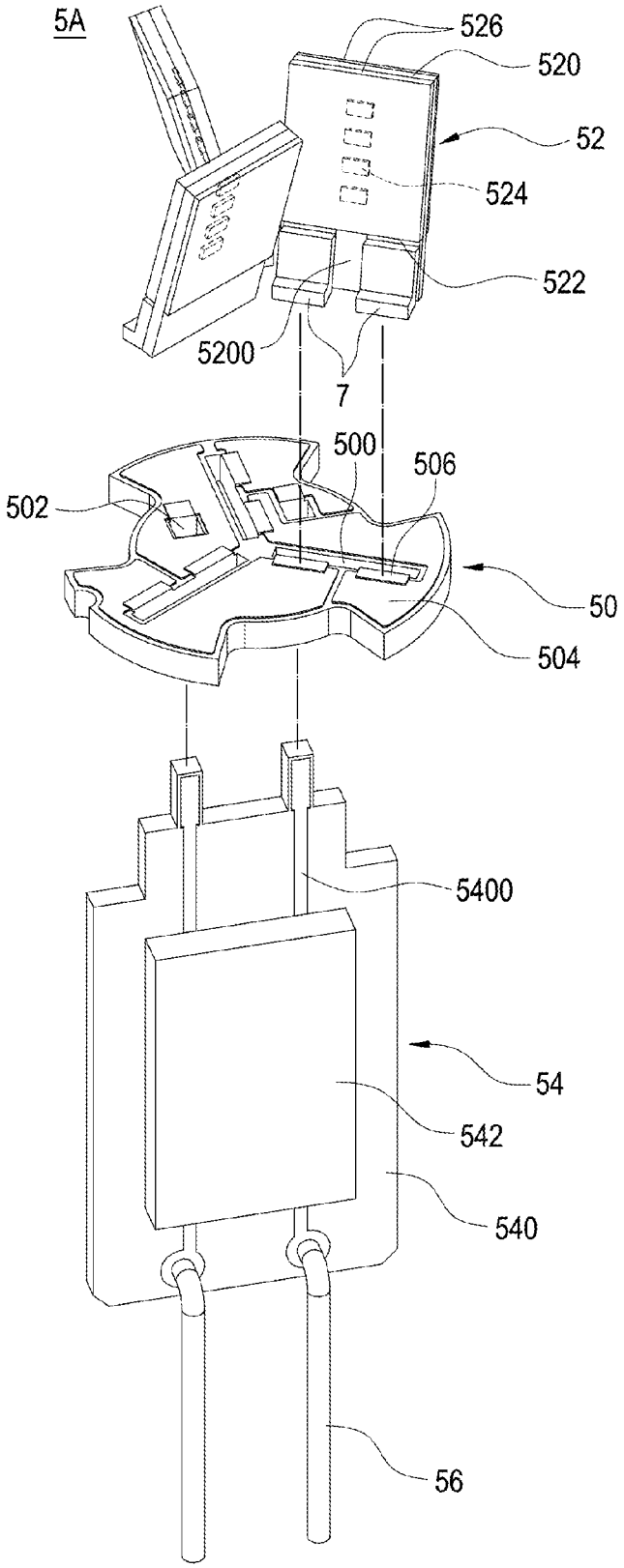
FIG. 7 is an explored view of a lighting module according to a second embodiment of the present invention.
Figure 8:
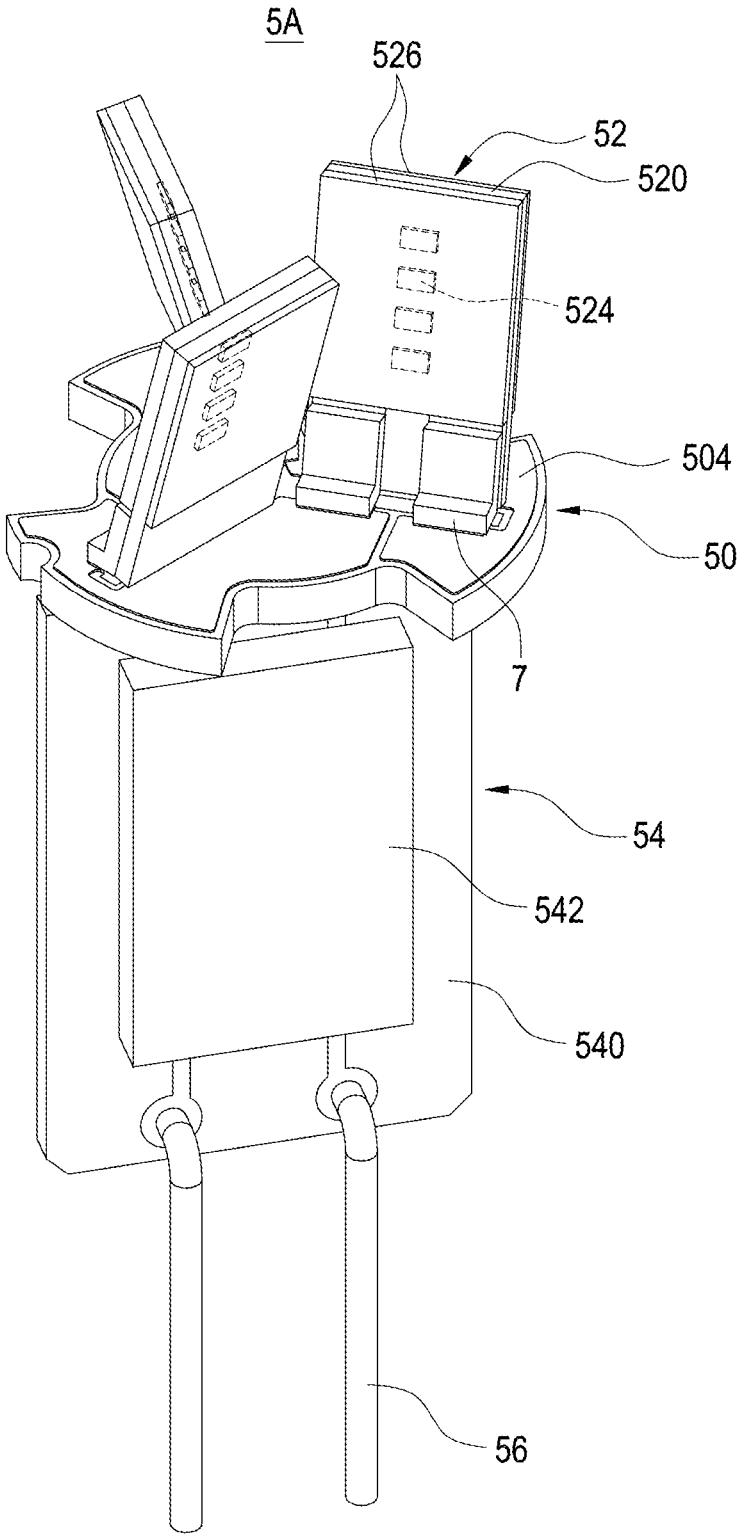
FIG. 8 is an assembled view of the lighting module according to the second embodiment of the present invention.

Reference is made to FIG. 7 and FIG. 8, which are respectively an explored view and an assembled view of a lighting module according to a second embodiment of the present invention. The lighting module 5A is similar to the lighting module 5 mentioned in the first embodiment, and the same reference numbers are used in the drawings and the description to refer to the same parts. It should be noted that the lighting module 5A further includes a plurality of connecting members 7.

The connecting members 7 are respectively connected between the pads 506 of the main circuit board 50 and the circuit layers 522 of the lighting units 52. The connecting members 7 are used for creating a predetermined angle spanning between the first surface 5200 of the transparent substrate 52 and the main circuit board 50 being larger than 90 degrees. Therefore, the illuminant angle of the lighting units 52 can be enlarged. However, the predetermined angle spanning between the first surface 5200 of the transparent substrate 520 and the main circuit board 50 can be smaller than 90 degrees. The connecting members 7 are made of material with electrically conductivity, thus the pads 506 of the main circuit board 50 are electrically connected to the circuit layers 522 of the lighting units 52 by the connecting members 7 arranged therebetween. The function and relative description of other components of the lighting module 5A are the same as that of first embodiment mentioned above and are not repeated here for brevity, and the lighting module 5A can achieve the functions as the lighting module 5 does.

An illuminant device can be formed by assembling the lighting module 5A with the housing 4 and the cover 6 mentioned in the first embodiment, and the illuminant device having the lighting module 5A can achieve the functions as the illuminant device 3 does.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A lighting module comprising:

a main circuit board including a plurality of through holes and a plurality of grooves, wherein the main circuit board further comprises one surface placed with a plurality of circuit traces and a plurality of pads, and wherein the pads are electrically connected to the circuit traces;

a plurality of lighting units arranged on the main circuit board and electrically connected to the main circuit board, each lighting unit comprising:

a transparent substrate comprising a first surface and a second surface opposite to the first surface, the transparent substrate inserted into the grooves formed on the main circuit board, respectively, and a predetermined angle spanning between the first surface of the transparent substrate and the main circuit board;

a circuit layer placed on the first surface;

a plurality of light emitting diode (LED) dies placed on the first surface and electrically connected to the circuit layer; and a transparent resin layer disposed on the first surface and the second surface, the transparent resin layer covering the LED dies and partially covering the circuit layer;

a driving unit comprising:

a driving circuit board comprising a plurality of protrusions inserted into the through holes such that the driving circuit board is substantially perpendicular to the main circuit board and electrically connected to the main circuit board; and a driver placed on the driving circuit board and electrically connected to the driving circuit board, wherein the lighting units inserted into the grooves are arranged such that one end of each circuit layer which is not disposed with the transparent resin layer is accommodated within each of the grooves, and the circuit layer which is not disposed with the transparent resin layer is in contact with the pads of the main circuit board.

2. The lighting module in claim 1, wherein the predetermined angle is 90 degrees.

3. The lighting module in claim 1, further comprising a plurality of connecting terminals connected to the driving circuit board.

4. The lighting module in claim 1, wherein the lighting units are arranged on the main circuit board in an equiangular manner.

5. An illuminant device comprising:

a housing comprising a circumferential wall and a bottom wall connected to the circumferential wall, the circumferential wall and the bottom wall collectively forming an accommodating space and an opening communicating with the accommodating space, the bottom wall forming a plurality of penetrating holes;

a lighting module comprising:

a main circuit board sealing the opening, the main circuit board including a plurality of through holes and a plurality of grooves, wherein the main circuit board further comprises one surface placed with a plurality of circuit traces and a plurality of pads, and wherein the pads are electrically connected to the circuit traces;

a plurality of lighting units arranged on the main circuit board and electrically connected to the main circuit board, each lighting unit comprising:

a transparent substrate comprising a first surface and a second surface opposite to the first surface, the transparent substrate inserted into the grooves formed on the main circuit board, respectively, and a predetermined angle spinning between the first surface of the transparent substrate and the main circuit board;

a circuit layer placed on the first surface;

a plurality of light emitting diode (LED) dies placed on the first surface and electrically connected to the circuit layer; and a transparent resin layer disposed on the first surface and the second surface; the transparent resin layer covering the LED dies and partially covering the circuit board;

a driving unit arranged within the accommodating space, the driving unit comprising:

a driving circuit board comprising a plurality of protrusions inserted into the through holes, respectively, such that the driving circuit board is perpendicular to the main circuit board and electrically connected to the main circuit board; and a driver placed on the driving circuit board and electrically connected to the main circuit board, wherein the lighting units inserted into the grooves are arranged such that one end of each circuit layer which is not disposed with the transparent resin layer is accommodated within each of the grooves, and the circuit layer which is not disposed with the transparent resin layer is in contact with the pads of the main circuit board.

6. The illuminant device in claim 5, wherein the predetermined angle is 90 degrees.

7. The illuminant device in claim 5, further comprising a plurality of connecting terminals connecting to the driving circuit board and penetrating the penetrating holes.

8. The illuminant device in claim 5, wherein the 1 ing units are arranged on the main circuit board in an equiangular manner.

9. The illuminant device in claim 5, further comprising a cover assembled with the housing such that the lighting unit is arranged between the main circuit board and the cover.

10. The illuminant device in claim 9, wherein the cover comprises a supporting portion and a plurality of fastening portions connected to the supporting portion, the supporting portion is assembled with the housing such that a predetermined distance is formed between the fastening portions and the main circuit board, the fastening portions are correspondingly arranged on the lighting units.

* * * * *